US006126300A

United States Patent [19]

Lee

[11] Patent Number: 6,126,300

[45] Date of Patent: Oct. 3, 2000

[54] MULTI-STATE SHIPPABLE LAMPSHADE

[76] Inventor: Dominic Lee, Apt. 1C, Duke Garden, #2 Duke Street, Kowloon, Hong Kong, The Hong Kong Special Administrative Region of the People's Republic of China

[21] Appl. No.: 09/221,506

[22] Filed: Dec. 28, 1998

Related U.S. Application Data

[60] Provisional application No. 60/068,938, Dec. 29, 1997.

[51] Int. Cl.[7] ..... F21V 1/06

[52] U.S. Cl. ..... 362/352; 362/294; 362/345

[58] Field of Search ..... 362/352, 356, 362/294, 345, 448

[56] References Cited

U.S. PATENT DOCUMENTS 2,711,346 6/1955 Wells ..... 362/352

3,075,074 1/1963 Asher ..... 362/352

*Primary Examiner*—Stephen Husar

*Attorney, Agent, or Firm*—Aufrichtig Stein & Aufrichtig, P.C.; Peter D. Aufrichtig

[57] ABSTRACT

A protective, reversibly convertible lampshade. A first rigid frusto-conical section is adapted to receive a bulb socket. A second intermediate section is coupled to the first section and has a generally frustumated cone shape with the narrower end coupled to the broader end of the first frusto-conical section. The second section has a series of radially oriented slits for providing flexible movement of the second section relative to the first section. A third, frusto-conical section, the narrower end of the third frusto-conical section is coupled to the wider end of the second frusto-conical section. The third frusto-conical section is formed of a rigid material. Application of force to the first and second sections acts to cause the intermediate section to bend and fold relative to the first and third sections so that the volume of the lampshade is reduced in a reversible fashion.

20 Claims, 5 Drawing Sheets

MULTI-STATE SHIPPABLE LAMPSHADE

This application claims the benefit of U.S. Provisional Application Ser. No. 60/068,938 filed Dec. 29, 1997.

BACKGROUND OF THE INVENTION

The invention is generally directed to a multi-state shippable lampshade and in particular to a multi-state shippable lampshade which is reversibly compressible from an enlarged operational configuration to a compacted, conveniently shippable, reduced volume configuration.

In the past there have been many different types of lampshades which are formed of rigid materials which have created problems in shipping and packaging. Generally, the rigid lampshade materials have been susceptible to damage unless the lampshade is completely protected from damage during shipping and handling. The protection has generally required a rigid outer container sized to enclose the lampshade and an inner thin plastic bag or cover to protect the surface of the lampshade from contact damage. While often of large volume, the lampshade is often extremely light. Thus, there would be a great reduction packaging, in shipping costs and warehousing costs and space requirements if the lampshades were capable of being reduced in size for packaging and shipping purposes and expanded back to a display size when either on display in a retail store or in an ultimate consumer's possession for installation on a lighting fixture.

Another type of lampshades which have existed are soft material lampshades which are designed to fold essentially flat and then expand for use. An example of this type is an oriental paper lampshade which is adapted to flatten or expand freely. Generally, but not always, these types of lampshades are formed with limited or no supports to maintain the structure of the lampshade in its expanded operational configuration. These lampshades do not generally provide rigid surfaces which are often desirable for bulb protection purposes.

There are also utility lights which are utilized by professional tradesmen and home do-it-yourselfers, which can clip to a work surface or a wall, door, hook, tree, car hood or other convenient location to illuminate a car, workshop bench or workpiece either in a fixed or movable location. For these purposes there is a need for the lampshade to serve several purposes. The lampshade must act as a support for the light fixture, which is generally little more than a light bulb socket or the like. The lampshade must also act as a reflector to focus, direct and intensify the light from the bulb in the indicated direction. In addition, the lampshade must also be sufficiently rigid and sturdy to protect the bulb from damage if the lamp falls or is hit inadvertently in the course of its use.

To meet the above three requirements, utility lights which are clamped to a desired location have been formed of a metal (often aluminum due to its relatively light weight) in a generally conical shape, with the vertex of the cone having an opening which contains a light fixture, the bulb being supported within the volume of the opened cone so that the interior surface of the cone protects the light bulb and acts as a reflector of the light emitted by the light bulb. This construction, in which a clamp is generally added to the exterior of the cone to act as a support for the lampshade, allows connection to a wide variety of surfaces. However, these lampshades are essentially completely rigid without any possibility of compression for shipping purposes. This results in the lamps, which generally include a light socket, generally with a switch of some sort and power cord and a shade member. Packaging of a lamp, either in kit form with the parts unassembled or as a finished construction, is difficult because of the bulkiness of the lampshade portion of the lamp. The packaging must fit the finished size of the lampshade, which is generally the largest component. This means increased packaging and shipping cost for the manufacturer, which must pay more for the packaging and shipping and handling charges. A wholesaler must also spend more to store the large packaging and increased costs in connection with shipping to its customers. The retail store must use more of its valuable shelf space to display fewer of the lampshades and more of the in store storage area is used. Finally, the retail customer must carry a bulkier package.

Accordingly, there is a need for an improved portable lamp fixture with a rigid lampshade which can be packaged and shipped in a reduced volume configuration which can be expanded to its full volume configuration and which will retain the configuration it is in unless deliberate force is applied to the lampshade.

SUMMARY OF THE INVENTION

The invention is generally directed to a plastic clamp light in which the lamp shade is formed from a hard, light-reflective plastic material. The lamp shade is formed generally in the shape of a frustumated cone with the narrower end sized to receive a light bulb socket and extending outwardly with a circular cross section to a broad, rolled back rim. The shade includes three basic sections. The first is the small diameter bulb supporting portion of the reflector shade. Next is an accordion folded and slit containing intermediate section which bends as the shade is moved from its expanded position to its compressed position. The third portion is an outer annular section extending outwardly beyond the intermediate section and terminating in a rolled rim. Both the first and the third sections are formed as solid, smooth, ridged frusto-conical sections.

It is a further object of the invention to provide an improved lampshade which is shippable in a reduced volume configuration and then expandable to an operative, increased volume configuration.

A still further object of the invention is to provide an improved lampshade which is capable of folding in an intermediate section, between a rigid outer rim and a rigid inner rim upon deliberate application of force to the lampshade.

Yet another object of the invention is to provide an improved lampshade which is capable of folding in an intermediate section, between a rigid outer rim and a rigid inner rim upon deliberate application of force to the lampshade and to unfold the intermediate section upon a different deliberate application of force to the lampshade.

Still another object of the invention is to provide an improved rigid lampshade selectively movable between a first, operational configuration and a second, reduced size configuration suitable for packaging, storage and shipping.

Yet still a further object of the invention is to provide an improved lamp assembly including a light socket with attached power cord and lampshade which is designed to act as a reflector and bulb protector in its operational state and which may be selectively converted from its operational state to a second state which occupies less space and back again to the operational state.

Yet another object of the invention is to provide an improved rigid lampshade in a frusto-conical form which includes rigid inner and outer rim portions and an intermediate frusto-conical section which is compressible from a first, expanded state to a second, folded state and vice versa upon selective and deliberate application of force to the lampshade.

Still other objects and advantages of the invention will in part be obvious and will in part be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENT

Figure 1:
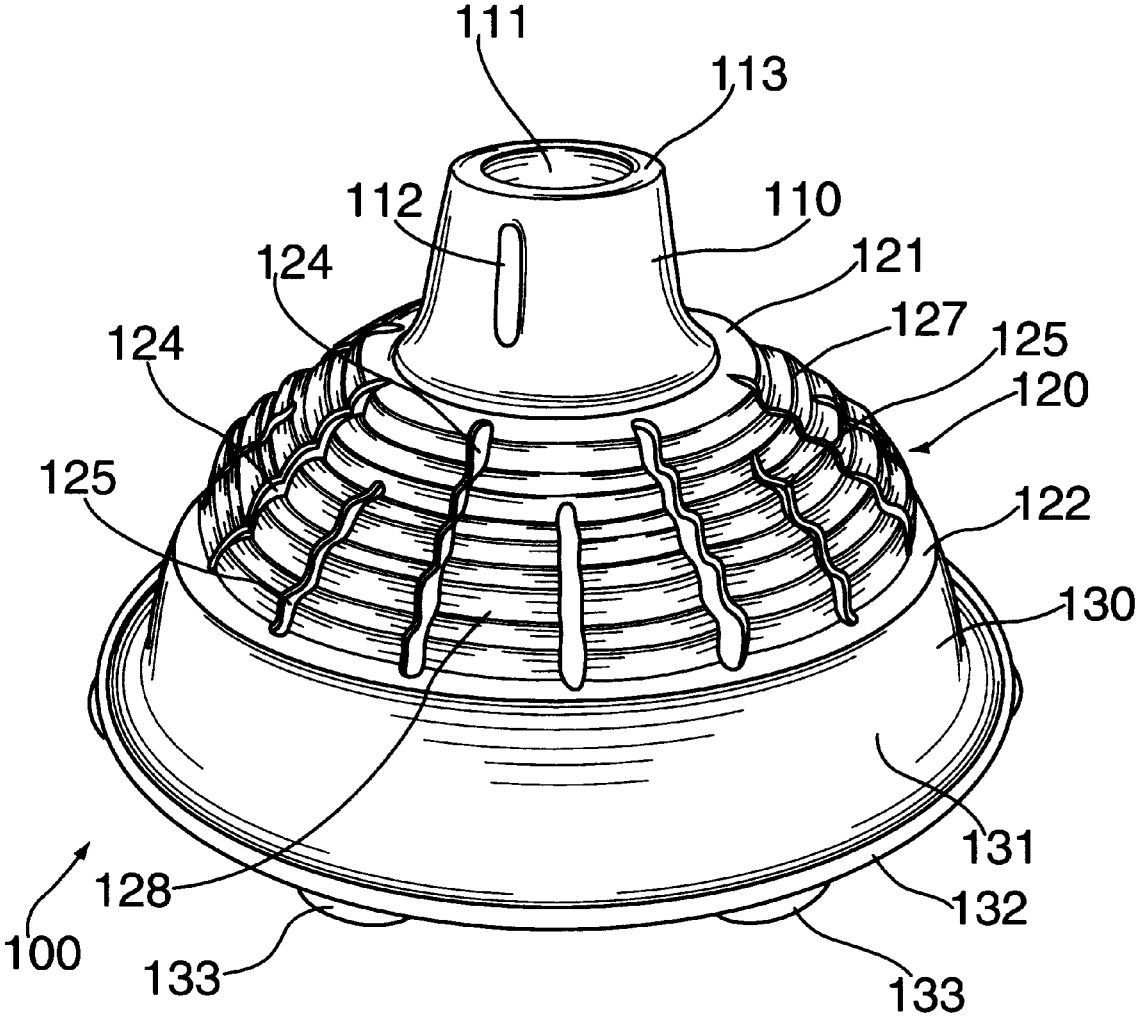
FIG. 1 is a perspective view of a lampshade constructed in accordance with a preferred embodiment of the invention in an operational state.
Figure 5:
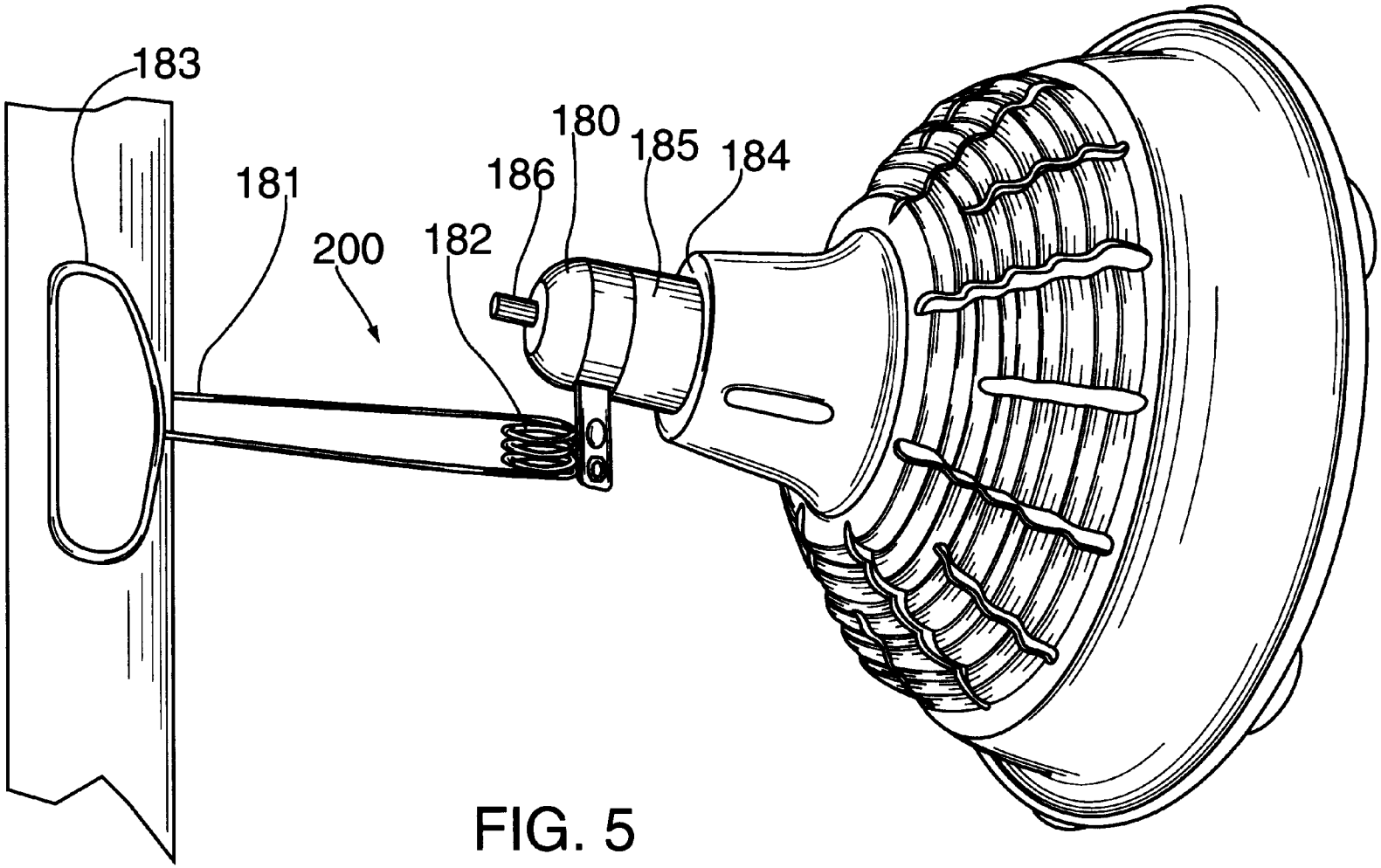
FIG. 5 is a perspective view of a lamp constructed in accordance with a preferred embodiment of the invention incorporating the lampshade of FIG. 1.

Reference is first made to FIG. 1 wherein a lampshade, generally indicated as 100, constructed in accordance with a preferred embodiment of the invention is depicted. Lampshade 100 includes a first inner frusto-conical section 110 and intermediate frusto-conical section 120 and an outer frusto-conical section 130. Inner section 110 includes a central opening 111 which is sized to receive a standard bulb socket assembly as shown in FIG. 5. The inside of inner frusto-conical section 110 about opening 111 has a series of protruding ribs (not shown) which are used to align and lock a light bulb socket assembly in place. In addition, there are a series of three lateral openings 112, one of which is shown in FIG. 1. These openings can be used either as a means for allowing heat to escape from the lampshade or as a means for attaching the socket assembly to the lampshade. The inner frusto-conical member is a rigidly formed member formed, as are the other sections, of a shiny hard plastic material, such as molded polypropylene. In the preferred embodiment the material used is polypropylene UL 94 HB, having a nominal thickness of between 1 and 10 millimeters, more preferably 2 and 5 millimeters and even more preferably 2.5 millimeters. The plastic is also generally polished to provide a reflective surface, at least on the interior of the lampshade 100. Inner core member 110 also has a rim section 113 around central opening 111 which provides a stable base for the attachment of the bulb socket. In a preferred embodiment, the interior of member 110 may be threaded to securely hold a light socket assembly.

Intermediate section 120 is formed with ribbing in a radial manner. In a preferred embodiment there are a series of five ridges 127 which extend at regular intervals between the top rim 121 and the bottom rim 122 of intermediate frusto-conical member 120. These rings are undulations on the outer surface intermediate section 120. The inner surface is generally smooth and without ridges. The effect is to create an arrangement in which there are variations in thickness of the section 120. In the section of the peaks, or ridges 127, the thickness is increased and in the valleys the thickness is reduced. In another preferred embodiment the inner surface would have a similar curvature as does the outer surface, such that a constant thickness of intermediate section 120 would be present. In a preferred embodiment this may be equal to 0.5 millimeters. However, it may also be established that values up to 2.5 or 3 millimeters in thickness is indicated. In addition to the ridges, there are a series of radially oriented long grooves 124 and shorter grooves 125. In a preferred embodiment, there are 8 long groves 124 about the circumference of intermediate section 120 and 8 short grooves 125 which alternate around the wall of intermediate section 120. The long grooves 124 extend from inner rim 121 to outer rim 122 of intermediate section 120. The shorter grooves 125 extend from outer rim 122 only a portion of the way to inner rim 121. In a preferred embodiment these shorter grooves 125 extend approximately two thirds of the way from outer rim 122 to inner rim 121. A pair of adjoining long grooves 124 with a short groove 125 therebetween defines a generally inverted V-shaped section 128. There are 8 of these generally V-shaped sections 128 around the circumference of intermediate section 120. Again, the inner surface of intermediate section 120 is generally polished so as to provide a shiny, reflective surface for the lampshade. Intermediate section 120 is generally formed or molded together with inner cone section 110 and outer cone section 130 out of a rigid plastic such as polypropylene.

Outer cone section 130 includes a smooth central band portion 131 and a rolled rim portion 132. In a preferred embodiment at least the interior of central band portion 131 is polished. Outer rim 132 is formed in a rolled over fashion to provide additional structural rigidity to this section so that, even under application of substantial force, it will not deform. This is important to the protective function of lampshade 120.

Figure 2:
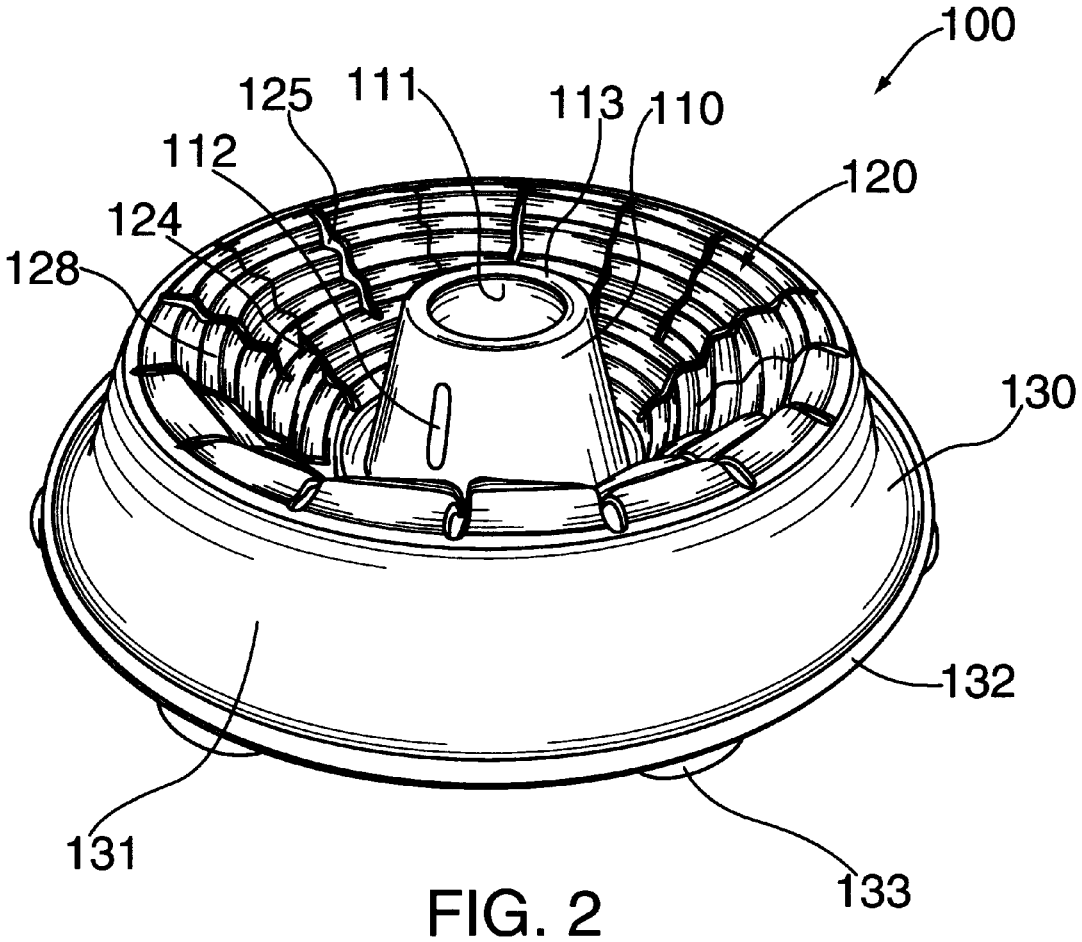
FIG. 2 is a perspective view of the lampshade of FIG. 1 in its compressed, packaging state.

Upon application of a compressive force applied to the top of inner cone section 110 and the bottom of outer cone section 130, intermediate section 120 folds inwardly to the position shown in FIG. 2. In this position, as better shown in FIG. 4, the height of lampshade 100 is effectively reduced to almost one half of its original height. The folding occurs by the movement of inverted V-shaped sections 128 bending downwardly with rotation about upper rim 121 and lower rim 122. With the combination of longer cuts 124 and shorter cuts 125 a defined folding structure is created which allows the rigid material of intermediate section 120 to deform and in a stable fashion be retained in the reduced size configuration of FIGS. 2 and 4. Depending upon the width of long slits 124, the V-shaped sections 128 can either freely move between the operational position shown in FIG. 1 and the packaging or storage position of FIG. 2, or, with narrow openings, provide an interlaced arrangement in which adjacent V-shaped sections 128 overlap. This overlap feature provides a positive lock on the lampshade so that it does not revert to the operational configuration shown in FIGS. 1 and 3.

In addition, a series of ridges 133 are placed around the bottom of section 130. Ridges 133 have the effect of spacing the bulb (not shown) placed in lampshade 100 further from a surface on which section 130 could rest. This keeps the intense heat of the bulb from burning a surface on which it rests. It also provides an airway between section 130 and a surface that it rests on to allow dissipation of heat.

Figure 4:
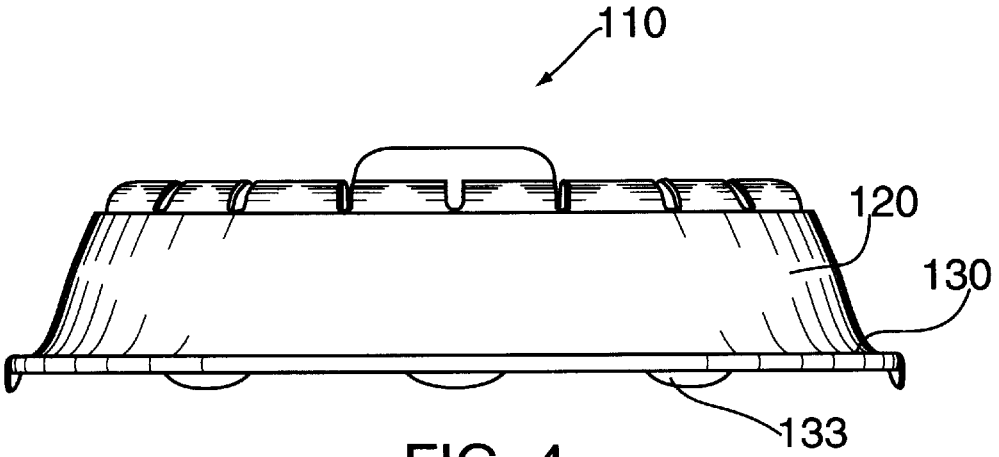
FIG. 4 is a front elevational view of the lampshade of FIG. 2.

In a preferred embodiment the lampshade 100 in the shipping or packaging configuration shown in FIGS. 2 and 4 can be attached to a conventional clamp and socket arrangement, generally indicated as 180, shown in FIG. 5 and then placed conveniently for packaging in a box. When folded down and fully assembled with a clamp assembly, the unit can be packed in a presentable square or rectangular gift box which conserves at least one third of the shipping space which would be required if the lampshade 100 did not compress into the packaging configuration shown in FIGS. 2 and 4.

Figure 3:
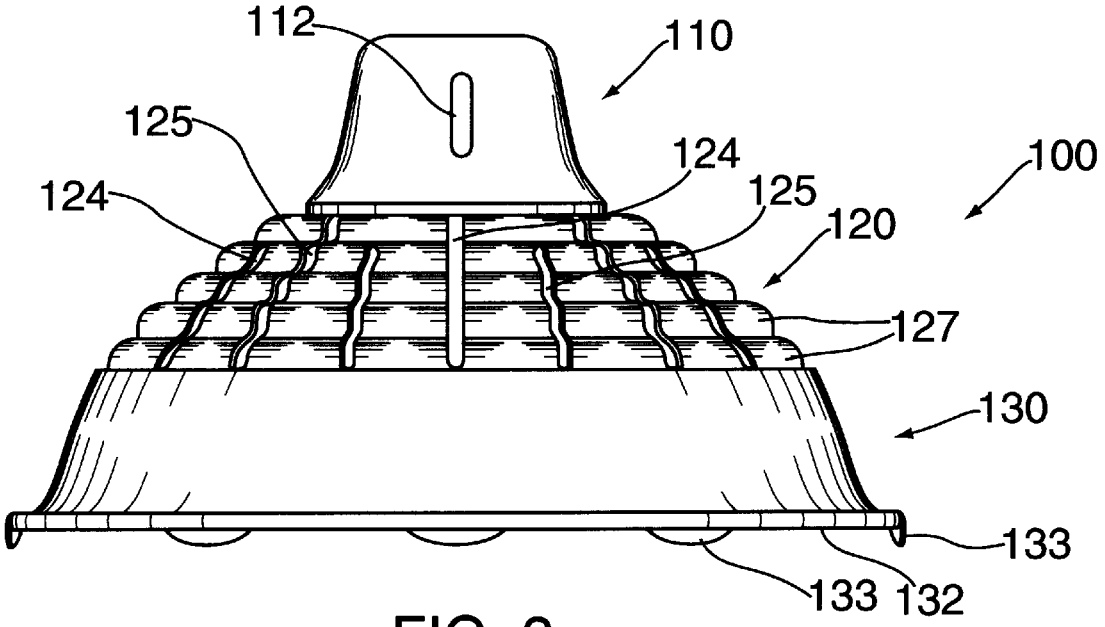
FIG. 3 is a front elevational view of the lampshade of FIG. 1 in its operational state.

By a simple application of a reversed force to the inside of inner rim 121 and compressive force on the outer rim 122 or applying force on the rounded rim 132, the lampshade 100 will return to the configuration shown in FIGS. 1 and 3, with the V-shaped sections 128 again rotating back to the position shown in FIGS. 1 and 3 for operational use of the lampshade and light fixture. The force required is dependant upon the thickness of the walls of the lampshade 100 and, in particular, intermediate section 120, and the width of the long and short slits 124, 125.

Reference is next made to FIG. 5 in which a complete clamp lamp assembly 200, generally constructed in accordance with a preferred embodiment of the invention is depicted. The assembly 200 includes a lampshade 100 in accordance with the preferred embodiment of the invention described above. A clamp and socket arrangement 180 is shown. The clamp and socket assembly 180 includes a clamp portion 181, including spring portion 182, clamping members 183, socket coupling section 184, light bulb socket 185, switch 186 and a power cord, not shown. Of course, it is possible for the lamp to be formed as a battery operated apparatus although generally, this is not indicated.

The lampshade 100 is shown in its operational state with intermediate section 120 in its extended state or configuration and providing a generally frusto-conical reflective surface on the interior surface of lampshade 100. A light bulb (not shown) is screwed into the portion of socket 185 which extends to inner conical section 110 so that the light from the bulb (not shown) is projected out of the open end of outer conical section 130 in the direction desired by the user. The long and short slits 124, 125 serve several functions in the operational stage. First they allow heat built up by the light bulb to be conveniently removed from the interior of the lampshade. They also act as a shock absorbing feature in the event that the lamp assembly 200 falls with a light bulb in it. The rigid sections 110 and 130 of the lampshade are cushioned to some extent by the flexible intermediate section 120. Of course, these openings also allow a certain amount of light to escape from within lampshade 100 so that the area in which the lamp 200 is fixed is also, to some limited extent, lit.

The ability to compress the lampshade 100 from its operational, fully expanded shape as shown in FIGS. 1, 3 and 5, to the compressed, packaging or shipping configuration shown in FIGS. 2 and 4 is of substantial commercial and functional importance. By reducing the volume of the lampshade it can be more easily shipped, stored and packaged without affecting the operational effectiveness of the lampshade. In addition, the arrangement of the ribs and the long and short cuts 124, 125, together with inner and outer rims 121, 122 establish two distinct stable states or configurations for lampshade 100. The lampshade will not move on its own from one configuration or state to the other without the deliberate application of force to the lampshade.

Figure 6:
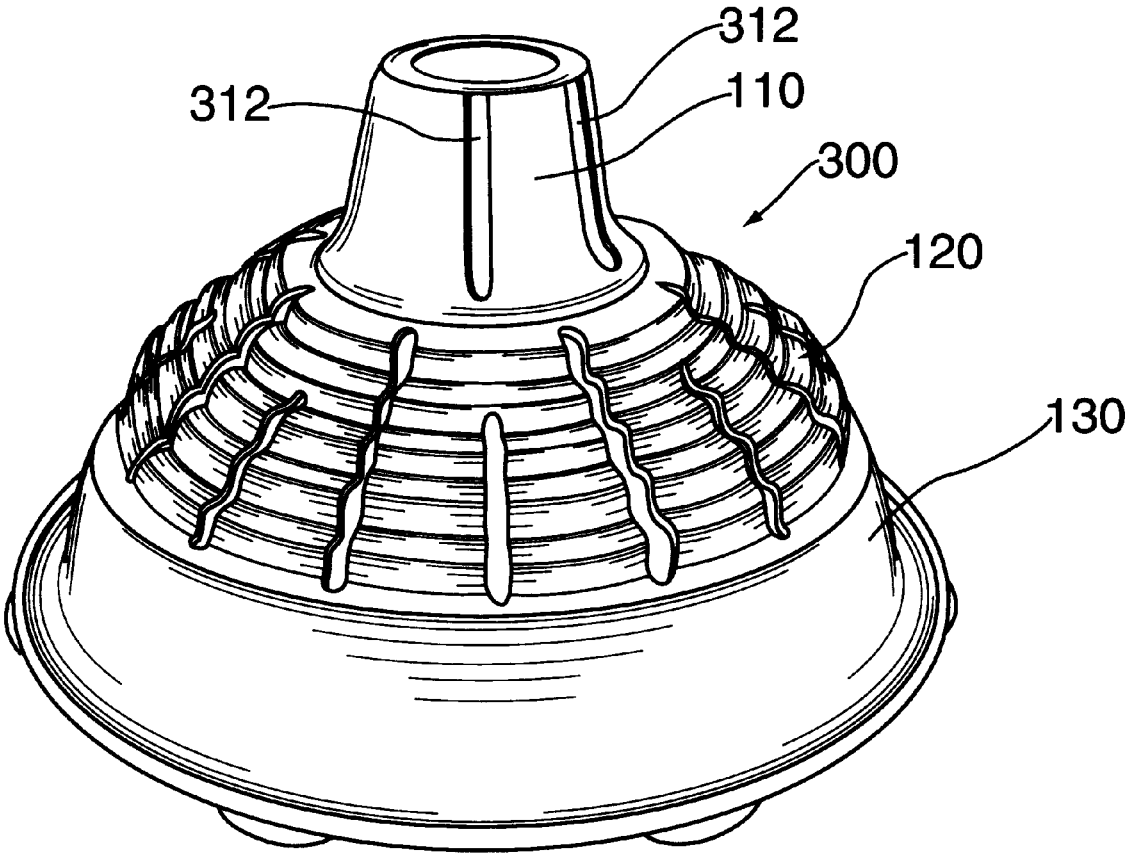
FIG. 6 is a perspective view of a lamp constructed in accordance with another preferred embodiment of the invention.

Reference is next made to FIG. 6 wherein a lampshade 300 constructed in accordance with another preferred embodiment of the invention is depicted, like elements being represented by like reference numerals. The embodiment of FIG. 6 varies from that of FIG. 1 by virtue of the expanded slots 312 in first section 110. Expanded slots 312 vent substantially more of the heat of a light bulb placed in lampshade 300 which allows the lamp to function more safely as heat does not build up in the lampshade as greatly. This is particularly important if the lamp is rested on a flat surface while the light bulb is on (a contraindicated but common situation in use). There are in a preferred embodiment six slots 312, rather than the three slots 112 in the embodiment of FIG. 1. Alternative numbers and sizes of slots 312 may be used depending on design requirements, such as the size, wattage and shape of the bulb to be used in the lampshade.

Accordingly an improved lampshade and lamp assembly which can convert from a fully extended operational configuration to a reduced volume packing, shipping and storing configuration with reversible and deliberate application of force to the lampshade is provided.

Accordingly, it will thus be seen that the objects set forth above, among those made apparent from the preceding description are efficiently attained and, since certain changes may be made in the above constructions without departing from the spirit and scope of the invention, it is intended that all of the matter contained in the above description or shown in the accompanying drawings, shall be interpreted as illustrative, and not as limiting.

It is also to be understood that the following claims are intended to cover all of the generic and specific features of the invention, herein described and all statements of the scope of the invention which, as a matter of language, might be said to fall therebetween.

What is claimed is:

1. A protective, reversibly convertible lampshade, comprising:

first rigid frusto-conical section adapted to receive a bulb socket;

a second intermediate section coupled to the first section having generally the shape of a frustumated cone with the narrower end coupled to the broader end of the first frusto-conical section, the second section having a series of radially oriented slits for providing flexible movement of the second section relative to the first section; and a third frusto-conical section, the narrower end of the third frusto-conical section being coupled to the wider end of the second frusto-conical section, the third frusto-conical section being formed of a rigid material; whereby application of force to the first and second sections acts to cause the intermediate section to bend and fold relative to the first and third sections so that the volume of the lampshade is reduced in a reversible fashion.

2. The protective, reversibly convertible lampshade of claim 1 wherein the radially oriented slits include slits of a first length and of a second length.

3. The protective, reversibly convertible lampshade of claim 2 wherein the slits of the first length are greater in length than the slits of the second length.

4. The protective, reversibly convertible lampshade of claim 3 wherein there are an equal number of slits of the first length and slits of the second length.

5. The protective, reversibly convertible lampshade of claim 3 wherein the slits of the first length and slits of the second length alternate around the second intermediate section.

6. The protective, reversibly convertible lampshade of claim 5 wherein a pair of slits of the first length and a slit of the second length between the pair of slits of the first length form a V-shaped section adapted to fold inwardly into the interior of the space occupied by the second intermediate section prior to folding.

7. The protective, reversibly convertible lampshade of claim 1 wherein the first, second and third sections are integrally formed.

8. The protective, reversibly convertible lampshade of claim 7 wherein the first, second and third sections are formed of a single material.

9. The protective, reversibly convertible lampshade of claim 1 wherein the first section includes coupling members for receiving a socket assembly.

10. The protective, reversibly convertible lampshade of claim 1 wherein the lampshade includes a socket assembly coupled to the first section.

11. The protective, reversibly convertible lampshade of claim 1 wherein the first section includes at least one heat sinking vent for venting the heat of a light bulb placed in the lampshade.

12. The protective, reversibly convertible lampshade of claim 11 wherein there are at least two heat seeking vents arranged radially about the first section.

13. The protective, reversibly convertible lampshade of claim 1 wherein the first section is a frusto-conical section with the larger end coupled to the second section and the smaller end is a free end adapted to receive the lamp socket including an opening through which the lamp socket can extend.

14. The protective, reversibly convertible lampshade of claim 5 wherein a pair of slits of the first length and a slit of the second length between the pair of slits of the first length form a V-shaped section adapted to fold inwardly into the interior of the space occupied by the second intermediate section prior to folding.

15. A protective lamp, comprising:

a reversibly convertible lampshade including a first rigid frusto-conical section adapted to receive a bulb socket; a second intermediate section coupled to the first section having generally the shape of a frustumated cone with the narrower end coupled to the broader end of the first frusto-conical section, the second section having a series of radially oriented slits for providing flexible movement of the second section relative to the first section; and a third frusto-conical section, the narrower end of the third frusto-conical section being coupled to the wider end of the second frusto-conical section, the third frusto-conical section being formed of a rigid material; whereby application of force to the first and second sections acts to cause the intermediate section to bend and fold relative to the first and third sections so that the volume of the lampshade is reduced in a reversible fashion; and socket means for receiving a bulb, coupled to the first section of the lampshade.

16. The lamp of claim 15 wherein the socket means includes a power cord for providing energy to a bulb placed in the socket means and a switch for turning the bulb on and off.

17. The lamp of claim 16 wherein the radially oriented slits include slits of a first length and of a second length.

18. The lamp of claim 17 wherein the slits of the first length are greater in length than the slits of the second length.

19. The lamp of claim 18 wherein there are an equal number of slits of the first length and slits of the second length.

20. The lamp of claim 17 wherein the slits of the first length and slits of the second length alternate around the second intermediate section.

* * * * *